US012623873B2

(12) United States Patent
Zhong et al.

(10) Patent No.: US 12,623,873 B2
(45) Date of Patent: May 12, 2026

(54) DOUBLE-SHEET DETECTION DEVICE

(71) Applicant: Guangzhou Baiyi intelligent equipment Co., LTD, Guangzhou (CN)

(72) Inventors: Qingxin Zhong, Guangzhou (CN); Wenjian Tang, Guangzhou (CN); Feifei Yu, Guangzhou (CN)

(73) Assignee: Guangzhou Baiyi intelligent equipment Co., LTD, Guangzhou (CN)

( * ) Notice: Subject to any disclaimer, the term of this patent is extended or adjusted under 35 U.S.C. 154(b) by 23 days.

(21) Appl. No.: 18/743,334

(22) Filed: Jun. 14, 2024

(65) Prior Publication Data

US 2024/0327158 A1 Oct. 3, 2024

(30) Foreign Application Priority Data

Apr. 12, 2024 (CN) ..... 202410438635.3

(51) Int. Cl.
*B65H 7/12* (2006.01)

(52) U.S. Cl.
CPC ..... *B65H 7/12* (2013.01); *B65H 2511/13* (2013.01); *B65H 2511/21* (2013.01); *B65H 2553/61* (2013.01)

(58) Field of Classification Search
CPC .. B65H 7/12; B65H 2511/13; B65H 2511/21; B65H 2553/61; B65H 7/02; B65H 5/06; B65H 7/20; B65H 5/062
USPC ..... 271/265.4, 265
See application file for complete search history.

(56) References Cited

U.S. PATENT DOCUMENTS

| | | | | |
|---|---|---|---|---|
| 7,270,325 | B2 * | 9/2007 | Sano | B65H 7/125 271/262 |
| 7,347,419 | B2 * | 3/2008 | Sano | B65H 5/062 271/262 |
| 7,552,924 | B2 * | 6/2009 | Sano | B65H 7/125 271/265.04 |
| 8,366,101 | B2 * | 2/2013 | Morita | B65H 3/0607 271/226 |
| 10,502,541 | B2 * | 12/2019 | Hsu | G01B 5/068 |
| 11,708,231 | B2 * | 7/2023 | Yoshimura | B65H 5/062 271/265.01 |
| 2001/0042956 | A1 * | 11/2001 | Minoru | B65H 7/125 271/265.04 |
| 2005/0184453 | A1 | 8/2005 | Sano et al. | |
| 2007/0018376 | A1 | 1/2007 | Sano et al. | |

* cited by examiner

*Primary Examiner* — Sameh Tawfik
(74) *Attorney, Agent, or Firm* — Hemisphere Law, PLLC

(57) ABSTRACT

The present disclosure relates to the technical field of double-sheet detection, and discloses a double-sheet detection device. The double-sheet detection device includes a paper feeding machine body, wherein a main body plate is arranged on an outer side of the paper feeding machine body; a detection mechanism is arranged on an inner side of the main body plate; the paper feeding machine body is provided with a storage assembly; the detection mechanism includes a U-shaped plate; and the U-shaped plate is arranged on the inner side of the main body plate. When a detection wheel rolls on the paper feeding machine body, after a piece of paper passes, a moving distance of the detection wheel on the paper is matched with a thickness of the paper, so as to determine the number of pieces of paper and achieve the purpose of double-sheet detection.

8 Claims, 8 Drawing Sheets

DOUBLE-SHEET DETECTION DEVICE

TECHNICAL FIELD

The present application relates to the technical field of double-sheet detection, and in particular, to a double-sheet detection device.

BACKGROUND

Double-sheet detection is generally applied to production of automobile parts, stamping, bending, and cutting procedures of metal components of household appliances such as a refrigerator, a washing machine, and a rice cooker, high-speed stamping of metal covers, stamping of other hardware accessories, and the like. In these production processes, double-sheet overlapping during automatic feeding needs to be prevented. In addition to the application to the above fields, to avoid such a situation that waste products appear in post processing and the processing quality is affected because two or more pieces of paper may not be found out in time, production and detection control instruments for preventing and controlling overlapping of two metal plates in mechanical equipment of metal pot packaging industries, such as a tin-plate printing press, a coating machine, a cutting machine, a punching machine, a cover press, a manipulator, and a pot body resistance welding machine, may often be provided with a double-sheet detection device for paper detection during paper processing and conveying.

Patent No. CN211569516U discloses a convenient-to-adjust double-sheet detection device for a paper feeding machine, including an assembling plate (on which a paper pressing wheel is mounted), a fixed plate, a connecting plate, an adjustment mechanism, and a cross roller guide rail. The fixed plate is provided with a through hole and a nut hole which are mutually orthogonal. An upper end of the assembling plate is fixedly connected to the connecting plate; a through hole is formed in the connecting plate; the adjustment mechanism includes a fine adjustment handle, a screw rod, a positioning nut, and a limiting assembly that limits the connecting plate on the screw rod; the positioning nut is mounted and clamped in the nut hole; an upper end of the screw rod is fixed to the fine-adjustment handle, and a lower end penetrates through the through hole and can rotatably pass through the through hole of the connecting plate and the positioning nut; the cross roller guide rail includes a mother guide rail and a child guide rail that are mutually matched with each other; the mother guide rail is fixedly connected to the assembling plate; and the child guide rail is fixedly connected to the fixed plate. The adjustment is very convenient. A distance between the paper pressing wheel and a paper feeding roller can be effectively adjusted by only rotating the fine adjustment handle.

Although the distance between the paper pressing wheel and the paper feeding roller can be flexibly adjusted according to thicknesses of different pieces of paper during feeding of the paper for detection, in an actual detection process, the above devices cannot take out the overlapping paper once there is paper overlapping, so that after a paper overlapping situation has been detected, the paper still needs to be taken out manually. This is troublesome.

SUMMARY

In order to solve the above problems, the present disclosure provides a double-sheet detection device.

The double-sheet detection device provided by the present application adopts the following technical solutions:

A double-sheet detection device includes a paper feeding machine body, wherein a main body plate is arranged on an outer side of the paper feeding machine body; a detection mechanism is arranged on an inner side of the main body plate; the paper feeding machine body is provided with a storage assembly;

the detection mechanism includes a U-shaped plate; the U-shaped plate is arranged on the inner side of the main body plate; an inner side top of the U-shaped plate is fixedly connected with a first damper; a bottom of the first damper is fixedly connected with a detection wheel; an angle sensor is mounted on the detection wheel; a first spring is fixedly connected to an exterior of the first damper; a top and bottom of the first spring are fixedly connected with the inner side top of the U-shaped plate and a top of the detection wheel, respectively; a rear side of the U-shaped plate is fixedly connected with a transverse plate; a movement slot is formed in the transverse plate; an interior of the movement slot is connected with a movable block; the movable block penetrates through the movement slot; a bottom of the movable block is fixedly connected with a first electric telescopic rod; a bottom of the first electric telescopic rod is fixedly connected with an auxiliary plate; a bottom of the auxiliary plate is fixedly connected with a circular tube; and a bottom of the circular tube is fixedly connected with a suction cup.

By the adoption of the above technical solution, in a process of feeding paper on the paper feeding machine body, the main body plate is pushed to the outer side of the paper feeding machine body; when the detection wheel rolls on the paper feeding machine body, after a piece of paper passes, a moving distance of the detection wheel on the paper is matched with a thickness of the paper, so as to determine the number of pieces of paper and achieve the purpose of double-sheet detection. Furthermore, once a paper overlapping situation occurs, the suction cup may be operated to suck the paper at the uppermost end of the overlapping paper, thus achieving the purpose of taking the overlapping paper and avoiding the phenomenon that after a double-sheet overlapping situation has been detected, the paper needs to be taken out manually.

Preferably, a top of the transverse plate is fixedly connected with a small air pump; an output end of the small air pump is fixedly connected with an exhaust pipe; the exhaust pipe penetrates through the auxiliary plate; and the exhaust pipe extends into the circular tube and is fixedly connected to the circular tube.

By the adoption of the above technical solution, the small air pump conveys air into the circular tube through the exhaust pipe, so that after the suction cup sucks a piece of paper, this can relieve the suction effect of the suction cup on the paper.

Preferably, a top of the transverse plate is fixedly connected with a connecting plate; one side of the connecting plate is fixedly connected with a second electric telescopic rod; and one end of the second electric telescopic rod is fixedly connected to one side of the movable block.

By the adoption of the above technical solution, the second electric telescopic rod can push and pull the movable block after being started.

Preferably, a bottom of the U-shaped plate is fixedly connected with a platform plate; a through slot is formed in the platform plate; and the first spring and the first damper both penetrate through the through slot.

By the adoption of the above technical solution, the first spring and the first damper can pass through the through slot. The first damper can promote the first spring to return to its initial state after the first spring is elastically stretched.

Preferably, the platform plate is provided with a hole slot; a front side of the detection wheel is fixedly connected with a frame plate; the frame plate penetrates through the hole slot; an interior of the frame plate is slidably connected with a moving plate; the moving plate extends out of the frame plate; a limiting slot is formed in a front side wall of the frame plate; a front side of the moving plate is fixedly connected with a limiting block; the limiting block penetrates through the limiting slot and is matched with the limiting slot; a front side of the frame plate is fixedly connected with a supporting plate; a top of the supporting plate is fixedly connected with a second damper and a second spring respectively; the second spring is arranged outside the second damper; and a top of the second damper and a top of the second spring are both fixedly connected to a bottom of the limiting block.

By adoption of the above technical solution, the second damper can promote the second spring to return to its initial state after the second spring is elastically stretched, and the moving plate can move flexibly inside the frame plate.

Preferably, a top of the platform plate is fixedly connected with an L-shaped plate; a strip plate is arranged on an inner side of the L-shaped plate; a bottom of the strip plate is fixedly connected with a switch; the switch is electrically connected to the paper feeding machine body; the switch is arranged at a top of the moving plate; the top of the platform plate is rotatably connected with a threaded adjustment rod; the threaded adjustment rod penetrates through the strip plate and is in threaded connection with the strip plate; the threaded adjustment rod penetrates through a top of the L-shaped plate and is rotatably connected to the L-shaped plate; the top of the platform plate is fixedly connected to a scale plate; the scale plate penetrates through the strip plate; and a top of the scale plate is fixedly connected to an inner side top of the L-shaped plate.

By the adoption of the above technical solution, the threaded adjustment rod can drive the strip plate to move after rotating, thereby adjusting a distance between the switch and the moving plate to meet a detection need of paper with different thicknesses. The scale plate is engraved with scales to indicate a moving distance of the strip plate. This improves the accuracy of adjustment.

Preferably, a bottom of the main body plate is fixedly connected with two bottom plates, and bottoms of the bottom plates are fixedly connected with universal wheels.

By the adoption of the above technical solution, the bottom plates are subjected to position adjustment and move through the universal wheels.

Preferably, the detection mechanism includes a push-pull assembly; the push-pull assembly includes two square plates; the two square plates are fixedly connected to the inner side top of the main body plate; a rear side of one square plate is fixedly connected with a motor; the motor is fixedly connected to a switch; the motor is fixedly connected with a threaded rotating rod through an output shaft; the threaded rotating rod penetrates through one of the square plates, and the threaded rotating rod is rotatably connected to the two square plates respectively; the top of the U-shaped plate is fixedly connected with a linkage plate; and the threaded rotating rod penetrates through the linkage plate and is in threaded connection with the linkage plate.

By the adoption of the above technical solution, after being started, the motor drives the threaded rotating rod, and the threaded rotating rod drives the linkage plate to move, thereby promoting the detection wheel to be able to automatically move to a paper position and achieving the purpose of automatic detection.

Preferably, the storage assembly includes a bearing plate; the bearing plate is fixedly connected to the paper feeding machine body; a placement frame is placed at a top of the bearing plate; the top of the bearing plate is fixedly connected with two positioning plates; and clamping slots are formed in the positioning plates.

By the adoption of the above technical solution, the bearing plate can provide placement support for the placement frame. After two or more pieces of overlapping paper are taken out, the paper can be put into the placement frame for temporary storage.

Preferably, the placement frame is fixedly connected with a rectangular plate; two grooves are formed in the rectangular plate; interiors of the grooves are slidably connected with clamping blocks; the clamping blocks extend out of the rectangular plate; the two positioning plates are respectively arranged on two sides of the rectangular plate; the positioning plates are in contact with the rectangular plate; the clamping blocks penetrate through the clamping slots and are matched with the clamping slots; one side of each clamping block is fixedly connected with an auxiliary spring; and the auxiliary springs are fixedly connected into the grooves.

By the adoption of the above technical solution, when the placement frame is placed at the top of the bearing plate, after the clamping blocks penetrate through the clamping slots, the clamping blocks can limit the rectangular frame, thereby further ensuring the stability of placement of the placement frame.

In summary, the present application includes the following beneficial technical effects:

According to the double-sheet detection device, due to the design of the detection mechanism, when the detection wheel rolls on the paper feeding machine body, after a piece of paper passes, a moving distance of the detection wheel on the paper is matched with a thickness of the paper, so as to determine the number of pieces of paper and achieve the purpose of double-sheet detection. Furthermore, once a paper overlapping situation occurs, the suction cup may be operated to suck the paper at the uppermost end of the overlapping paper, thus achieving the purpose of taking the overlapping paper and avoiding the phenomenon that after a double-sheet overlapping situation has been detected, the paper needs to be taken out manually.

According to the double-sheet detection device, due to the design of the push-pull assembly, after paper at the top of an overlapping part is taken down, the motor continues to work and drives the threaded rotating rod to rotate clockwise and anticlockwise once, and the detection wheel again presses through paper that has an overlapping position. If the switch is still touched during the pressing, paper at the uppermost part of the overlapping part is continued to be taken down and put into the placement frame for storage until the switch is no longer touched after the detection wheel presses through the paper at the overlapping part. The double-sheet detection device can effectively handle overlapping of multiple sheets in addition to handling overlapping of two sheets, so that the adaptability is higher; and high labor intensity caused by manual taking is avoided.

According to the double-sheet detection device, due to the design of the storage assembly, after paper is stored in the placement frame, a user can push the clamping blocks; after the clamping blocks move until they leave the clamping slots, the placement frame can be directly removed; and afterwards, the paper inside the placement frame can be treated in a unified way. The operation process is simple and convenient, and it is conductive for quick operation by the user.

Figure 1:
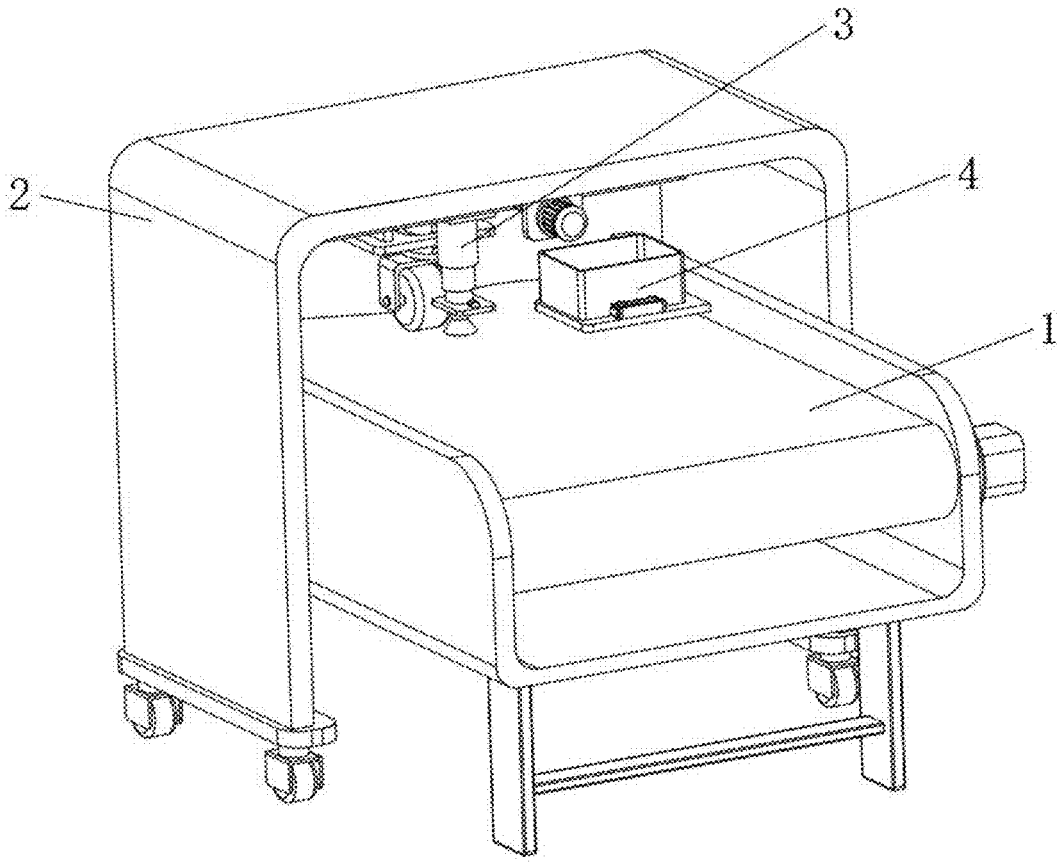
FIG. 1 is a schematic structural diagram of the present disclosure.

Reference numerals in the drawings: 1: paper feeding machine body; 2: main body plate; 3: detection mechanism; 31: U-shaped plate; 32: first damper; 33: detection wheel; 34: first spring; 35: transverse plate; 36: movement slot; 37: movable block; 38: first electric telescopic rod; 39: auxiliary plate; 391: circular tube; 392: suction cup; 393: small air pump; 394: exhaust pipe; 395: second electric telescopic rod; 396: platform plate; 397: frame plate; 398: moving plate; 399: limiting block; 381: supporting plate; 382: second spring; 383: L-shaped plate; 384: strip plate; 385: switch; 386: threaded adjustment rod; 387: scale plate; 388: bottom plate; 389: square plate; 371: motor; 372: threaded rotating rod; 373: linkage plate; 4: storage assembly; 41: bearing plate; 42: placement frame; 43: positioning plate; 44: rectangular plate; 45: clamping block; and 46: auxiliary spring.

DETAILED DESCRIPTION OF THE EMBODIMENTS

Figure 2:
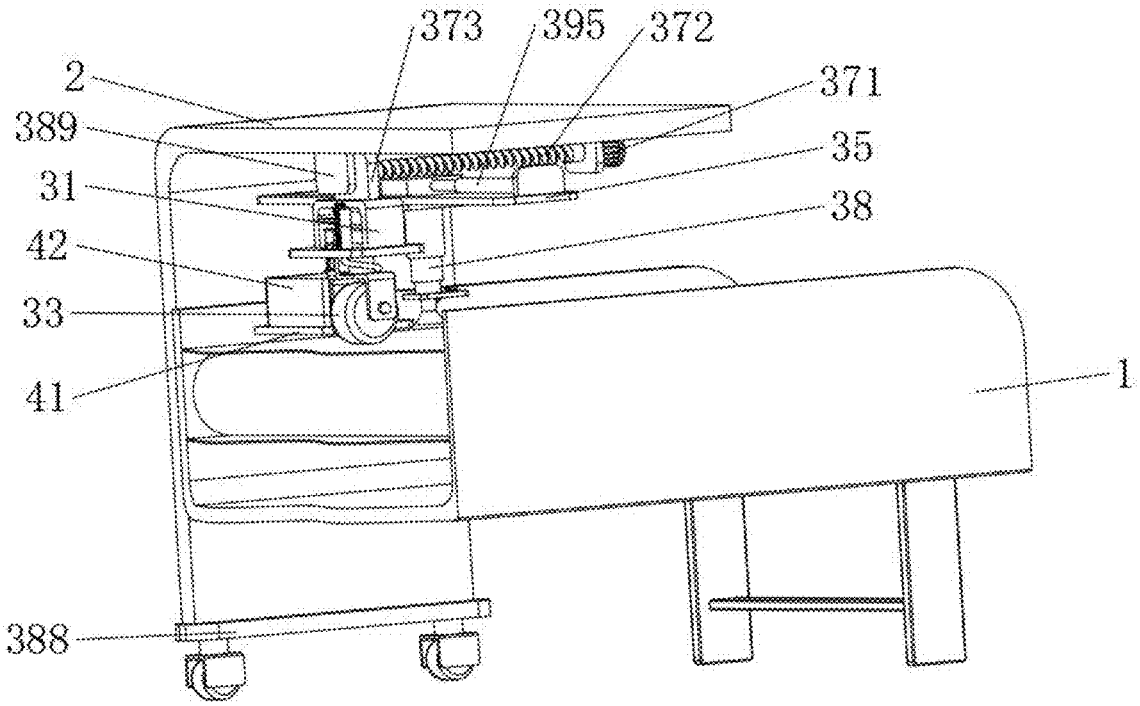
FIG. 2 is a structural cross-sectional diagram of the present disclosure.
Figure 3:
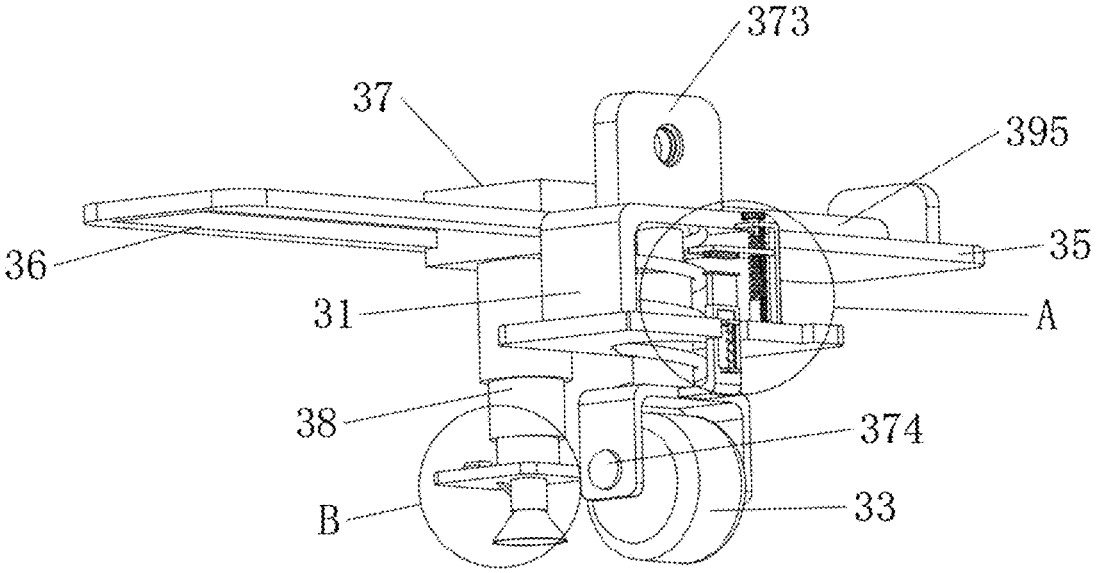
FIG. 3 is a structural cross-sectional diagram of a platform plate in the present disclosure.
Figure 4:
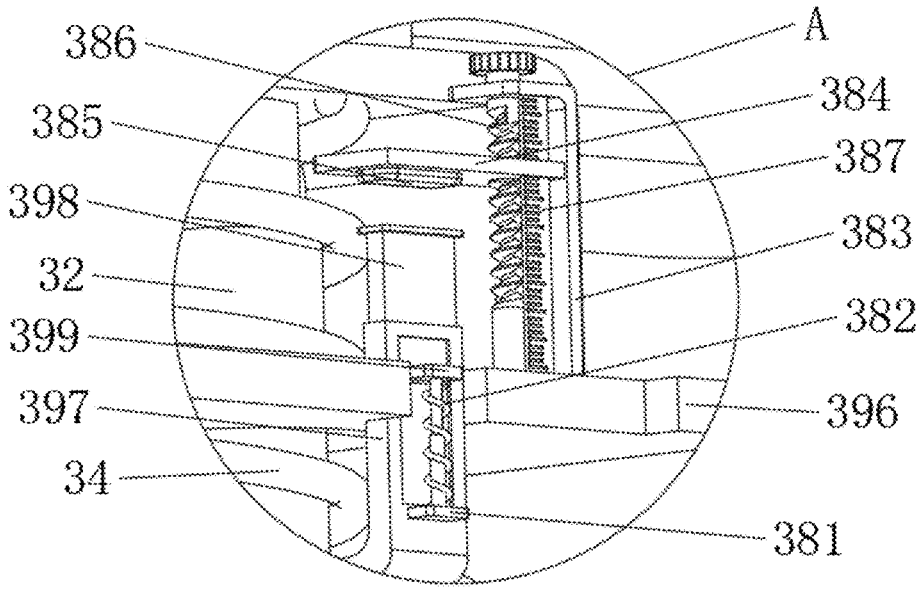
FIG. 4 is an enlarged view of the part A in FIG. 3.
Figure 5:
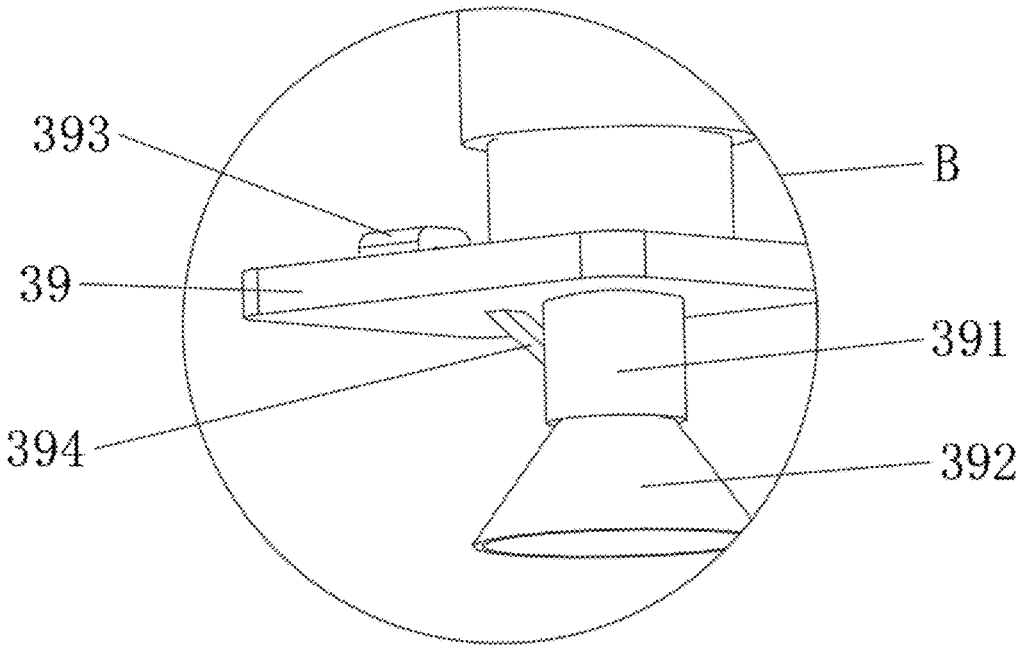
FIG. 5 is an enlarged view of the part B in FIG. 3.
Figure 6:
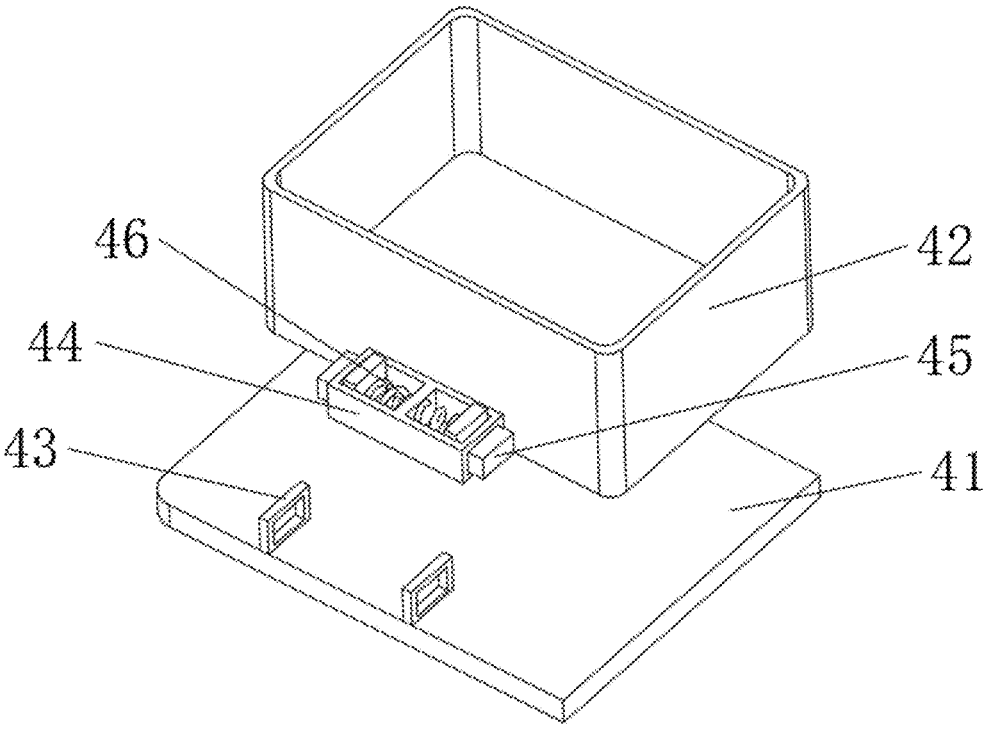
FIG. 6 is an exploded diagram of a placement frame and a bearing plate in the present disclosure.
Figure 7:
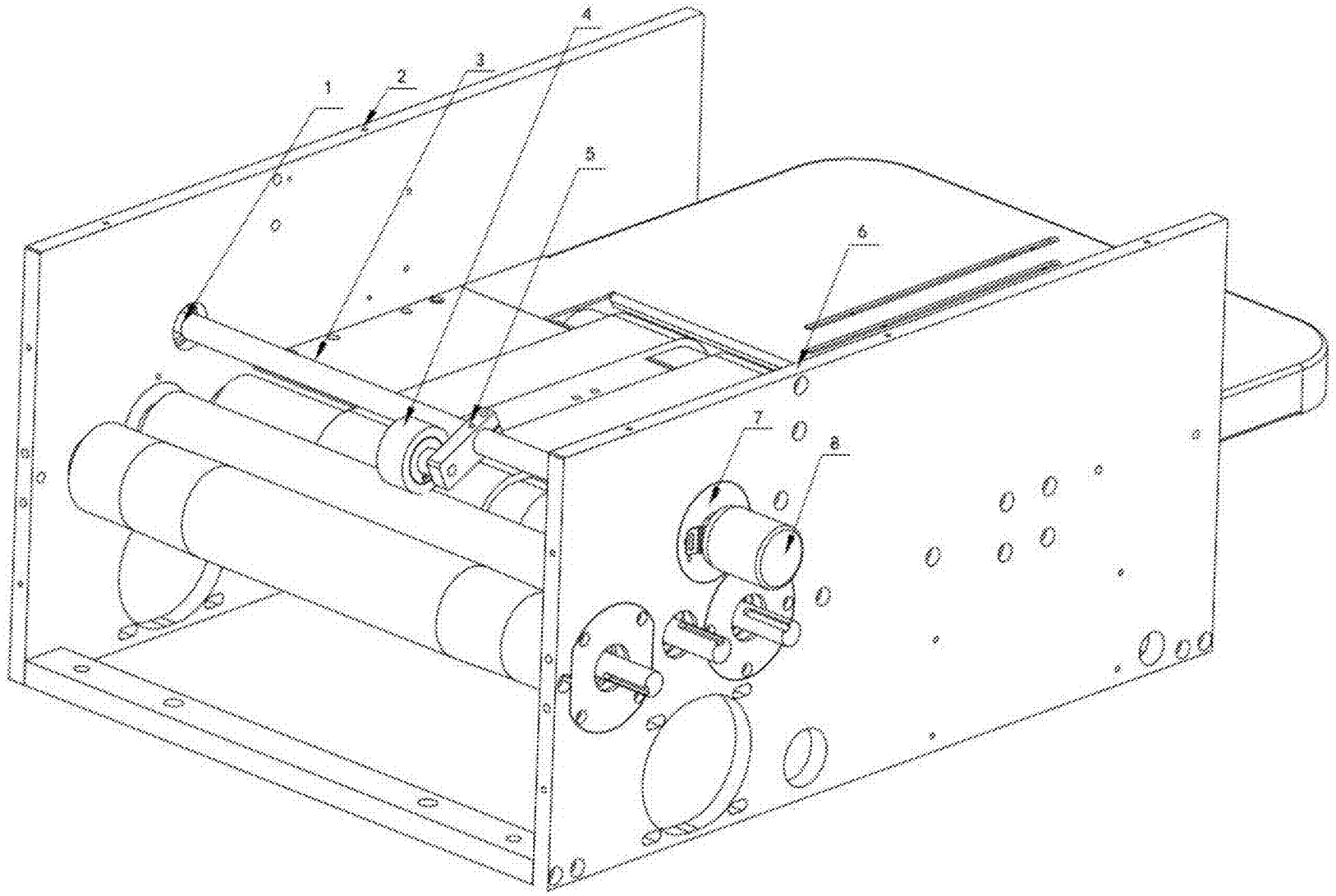
FIG. 7 is a structural diagram of Embodiment 3 of the present disclosure.
Figure 8:
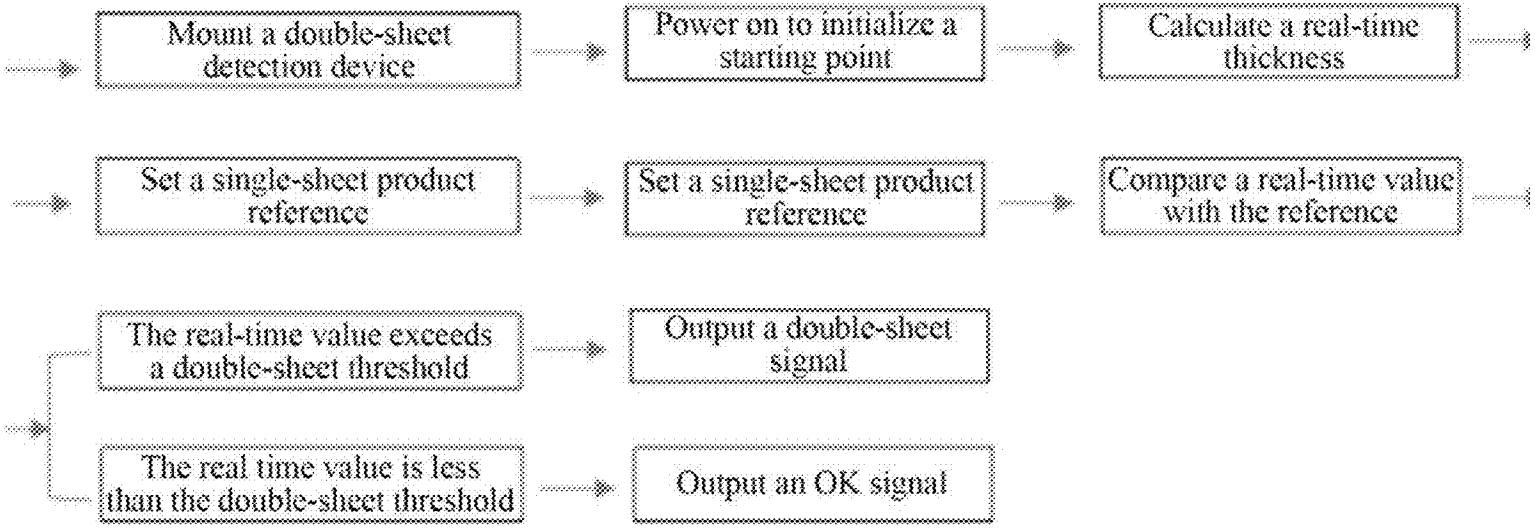
FIG. 8 is a flowchart of Embodiment 3 of the present disclosure.

The present disclosure will be further described in detail below in conjunction with FIG. 1 to FIG. 8.

Embodiment 1

The embodiments of the present disclosure disclose a double-sheet detection device. Referring to FIG. 1 to FIG. 6, the double-sheet detection device includes a paper feeding machine body 1, wherein a main body plate 2 is arranged on an outer side of the paper feeding machine body 1; a detection mechanism 3 is arranged on an inner side of the main body plate 2; the paper feeding machine body 1 is provided with a storage assembly 4; the detection mechanism 3 includes a U-shaped plate 31; the U-shaped plate 31 is arranged on the inner side of the main body plate 2; an inner side top of the U-shaped plate 31 is fixedly connected with a first damper 32; a bottom of the first damper 32 is fixedly connected with a detection wheel 33; an angle sensor 374 is mounted on the detection wheel 33; a first spring 34 is fixedly connected to an exterior of the first damper 32; a top and bottom of the first spring 34 are fixedly connected with the inner side top of the U-shaped plate 31 and a top of the detection wheel 33, respectively; a rear side of the U-shaped plate 31 is fixedly connected with a transverse plate 35; a movement slot 36 is formed in the transverse plate 35; an interior of the movement slot 36 is connected with a movable block 37;

the movable block 37 penetrates through the movement slot 36; a bottom of the movable block 37 is fixedly connected with a first electric telescopic rod 38; a bottom of the first electric telescopic rod 38 is fixedly connected with an auxiliary plate 39; a bottom of the auxiliary plate 39 is fixedly connected with a circular tube 391; and a bottom of the circular tube 391 is fixedly connected with a suction cup 392. In a process of feeding paper on the paper feeding machine body 1, the main body plate 2 is pushed to the outer side of the paper feeding machine body 1; when the detection wheel 33 rolls on the paper feeding machine body 1, after a piece of paper passes, a moving distance of the detection wheel 33 on the paper is matched with a thickness of the paper, so as to determine the number of pieces of paper and achieve the purpose of double-sheet detection. Furthermore, once a paper overlapping situation occurs, the suction cup 392 may be operated to suck the paper at the uppermost end of the overlapping paper, thus achieving the purpose of taking the overlapping paper and avoiding the phenomenon that after a double-sheet overlapping situation has been detected, the paper needs to be taken out manually.

A top of the transverse plate 35 is fixedly connected with a small air pump 393; an output end of the small air pump 393 is fixedly connected with an exhaust pipe 394; the exhaust pipe 394 penetrates through the auxiliary plate 39; and the exhaust pipe 394 extends into the circular tube 391 and is fixedly connected to the circular tube 391. The small air pump 393 conveys air into the circular tube 391 through the exhaust pipe 394, so that after the suction cup 392 sucks a piece of paper, this can relieve the suction effect of the suction cup 392 on the paper. A top of the transverse plate 35 is fixedly connected with a connecting plate; one side of the connecting plate is fixedly connected with a second electric telescopic rod 395; and one end of the second electric telescopic rod 395 is fixedly connected to one side of the movable block (37). The second electric telescopic rod 395 can push and pull the movable block 37 after being started.

A bottom of the U-shaped plate 31 is fixedly connected with a platform plate 396; a through slot is formed in the platform plate 396; and the first spring 34 and the first damper 32 both penetrate through the through slot. The first spring 34 and the first damper 32 can pass through the through slot. The first damper 32 can promote the first spring 34 to return to its initial state after the first spring 34 is elastically stretched. The platform plate 396 is provided with a hole slot; a front side of the detection wheel 33 is fixedly connected with a frame plate 397; the frame plate 397 penetrates through the hole slot; an interior of the frame plate 397 is slidably connected with a moving plate 398; the moving plate 398 extends out of the frame plate 397; a limiting slot is formed in a front side wall of the frame plate 397; a front side of the moving plate 398 is fixedly connected with a limiting block 399; the limiting block 399 penetrates through the limiting slot and is matched with the limiting slot; a front side of the frame plate 397 is fixedly connected with a supporting plate 381; a top of the supporting plate 381 is fixedly connected with a second damper and a second spring 382 respectively; the second spring 382 is arranged outside the second damper; and a top of the second damper and a top of the second spring 382 are both fixedly connected to a bottom of the limiting block 399. The second damper can promote the second spring 382 to return to its initial state after the second spring 382 is elastically stretched, and the moving plate 398 can move flexibly inside the frame plate 397.

A top of the platform plate 396 is fixedly connected with an L-shaped plate 383; a strip plate 384 is arranged on an inner side of the L-shaped plate 383; a bottom of the strip plate 384 is fixedly connected with a switch 385; the switch 385 is electrically connected to the paper feeding machine body 1; the switch 385 is arranged at a top of the moving plate 398; the top of the platform plate 396 is rotatably connected with a threaded adjustment rod 386; the threaded adjustment rod 386 penetrates through the strip plate 384 and is in threaded connection with the strip plate 384; the threaded adjustment rod penetrates through a top of the L-shaped plate 383 and is rotatably connected to the L-shaped plate 383; the top of the platform plate 396 is fixedly connected to a scale plate 387; the scale plate 387 penetrates through the strip plate 384; and a top of the scale plate 387 is fixedly connected to an inner side top of the L-shaped plate 383. The threaded adjustment rod can drive the strip plate 384 to move after rotating, thereby adjusting a distance between the switch 385 and the moving plate 398 to meet a detection need of paper with different thicknesses. The scale plate 387 is engraved with scales to indicate a moving distance of the strip plate 384. This improves the accuracy of adjustment. A bottom of the main body plate 2 is fixedly connected with two bottom plates 388, and bottoms of the bottom plates 388 are fixedly connected with universal wheels. The bottom plates 388 are subjected to position adjustment and move through the universal wheels.

The detection mechanism 3 includes a push-pull assembly; the push-pull assembly includes two square plates 389; the two square plates 389 are fixedly connected to the inner side top of the main body plate 2; a rear side of one square plate 389 is fixedly connected with a motor 371; the motor 371 is fixedly connected to a switch 385; the motor 371 is fixedly connected with a threaded rotating rod 372 through an output shaft; the threaded rotating rod 372 penetrates through one of the square plates 389, and the threaded rotating rod 372 is rotatably connected to the two square plates 389 respectively; the top of the U-shaped plate 31 is fixedly connected with a linkage plate 373; and the threaded rotating rod 372 penetrates through the linkage plate 373 and is in threaded connection with the linkage plate 373. After being started, the motor 371 drives the threaded rotating rod 372, and the threaded rotating rod 372 drives the linkage plate 373 to move, thereby promoting the detection wheel 33 to be able to automatically move to a paper position and achieving the purpose of automatic detection.

The storage assembly 4 includes a bearing plate 41; the bearing plate 41 is fixedly connected to the paper feeding machine body 1; a placement frame 42 is placed at a top of the bearing plate 41; the top of the bearing plate 41 is fixedly connected with two positioning plates 43; and clamping slots are formed in the positioning plates 43. The bearing plate 41 can provide placement support for the placement frame 42. After two or more pieces of overlapping paper are taken out, the paper can be put into the placement frame 42 for temporary storage. The placement frame 42 is fixedly connected with a rectangular plate 44; two grooves are formed in the rectangular plate 44; interiors of the grooves are slidably connected with clamping blocks 45;

the clamping blocks 45 extend out of the rectangular plate 44; the two positioning plates 43 are respectively arranged on two sides of the rectangular plate 44; the positioning plates 43 are in contact with the rectangular plate 44; the clamping blocks 45 penetrate through the clamping slots and are matched with the clamping slots; one side of each clamping block 45 is fixedly connected with an auxiliary spring 46; and the auxiliary springs 46 are fixedly connected into the grooves. When the placement frame 42 is placed at the top of the bearing plate 41, after the clamping blocks 45 penetrate through the clamping slots, the clamping blocks 45 can limit the rectangular frame, thereby further ensuring the stability of placement of the placement frame 42.

In an actual operation process, in a process of feeding paper by the paper feeding machine body 1, the main body plate 2 can be pushed to the outer side of the paper feeding machine, and the detection wheel 33 can roll on a surface of the paper feeding machine when the paper feeding machine body 1 works. At this time, a distance between the switch 385 and the top of the moving plate 398 can be adjusted according to a type and thickness of the transported paper. During adjustment, the threaded adjustment rod 386 can be rotated. The threaded adjustment rod 386 drives the strip plate 384 to move, and the strip plate 384 drives the switch 385 at the bottom to move. During the movement of the strip plate 384, due to the scales engraved on the scale plate 387, the strip plate 384 can obtain a specific parameter of a moving distance according to the scales on the scale plate 387, thereby ensuring the adjustment accuracy. After the transported paper passes through the detection wheel 33, the detection wheel 33 rolls on a surface of the paper. Due to the thickness of the paper, the detection wheel 33 may move up a distance that is equal to the thickness of the paper to achieve the purpose of detection. Meanwhile, the angle sensor 374 is coaxially connected to the detection wheel 33. As long as there is material passing, the angle sensor 374 will be driven through a rotating shaft. Through high-speed communication with the angle sensor 374, real-time data of the angle sensor 374 is obtained, and an actual thickness value of the material is calculated through an algorithm. The calculated actual thickness value is compared with a double-sheet material detection threshold; if the actual thickness value exceeds the double-sheet material detection threshold, a double-sheet signal is immediately sent, which can also achieve a purpose of double-sheet detection, so that in addition to a mode of detection by manual visual inspection of the scales, automatic detection is achieved synchronously; and the double-sheet detection via two modes greatly improves the flexibility and accuracy.

In a detection process, the algorithm is implemented in two modes; in early application, a programmable logic controller (PLC) is used to communicate with the angle sensor 374 at a high speed to obtain data of the angle sensor 374, and the data is converted into an angle value. The calculated angle value is subtracted by an angle value at an initial position to obtain an angle value of actual swinging; and in a case that a size of the detection wheel 33 is known, an actual offset of a pressing wheel is obtained by a trigonometric function operation, thus obtaining an actual thickness of the material. Different PLCs have different instructions and logics, which, to some extents, increases the workload of programming. The algorithm contains many logics and calculations, which will also bring a load to the calculation of the PLC and prolong the cyclic scanning time of the PLC. When the PLC has a large number of programs, the operating efficiency may be slightly affected. Based on this situation, a mode is added, in which, a 32-bit high-speed single-chip microcomputer is used to transplant the communication and the algorithm to a specially developed single-chip microcomputer; and the single-chip microcomputer directly outputs a result. In this way, the calculation speed is higher, and the calculation workload of the PLC is greatly reduced. Different PLCs do not need to consider developing special algorithms, so that the application is more flexible and convenient, and the application scenario is more diversified.

When two or more pieces of paper passing through the detection wheel 33 overlap, after pressing through the paper, the detection wheel 33 drives the frame plate 397 to move during the movement of the detection wheel 33, and the frame plate 397 drives the moving plate 398 to move. As a distance that the detection wheel 33 moves up is greater than a thickness of a single piece of paper, the moving plate 398 will touch the switch 385. The second spring 382 between the limiting block 399 and the supporting plate 381 can still enable the moving plate 398 to move back to the corresponding position inside of the frame plate 397 through the cooperation between the second spring 382 and the second damper if the moving distance is large. When the moving plate 398 stops touching the switch 385, the paper feeding machine body 1 stops feeding. At this time, the overlapping paper is located at the bottom of the suction cup 392. Afterwards, the first electric telescopic rod 38 drives the auxiliary plate 39 to move down until the suction cup 392 sucks the paper at the uppermost part of the overlapping part. Then, the second electric telescopic rod 395 drives the movable block 37 to move. When the sucked paper moves to the top of the placement frame 42, the small air pump 393 introduces air into the circular tube 391 through the exhaust pipe 394. At this time, the suction cup 392 releases the paper, and the paper falls into the placement frame 42 for storage.

After the above steps are completed, the motor 371 works and drives the threaded rotating rod 372 to rotate clockwise and anticlockwise once. During the clockwise rotation, the threaded rotating rod 372 drives the linkage plate 373 to move, and the linkage plate 373 drives the U-shaped plate 31 to move. Based on the above connection relationships, it can be seen that at this time, the detection wheel 33 again presses through paper that overlaps. If the switch 385 is still touched during the pressing, the threaded rotating rod 372 rotates anticlockwise. After the detection wheel 33 returns to its initial position, the suction cup 392 will repeat the above work. The paper at the uppermost part of the overlapping part is taken down and stored in the placement frame 42. The above steps are repeated until the switch 385 is no longer touched after the detection wheel presses through the paper at the overlapping part, and it indicates that the paper at this part no longer overlaps. The paper feeding machine body 1 can continue to feed the paper. Through the above steps, the double-sheet detection device can effectively handle the overlapping of multiple sheets in addition to handling overlapping of two sheets, so that the adaptability is higher; and high labor intensity caused by manual taking is avoided.

Finally, after the paper is stored in the placement frame 42, a user can push the clamping blocks 45; after the clamping blocks 45 move until they leave the clamping slots, the placement frame 42 can be directly removed; and afterwards, the paper inside the placement frame 42 can be treated in a unified way. The operation process is simple and convenient, and it is conductive for quick operation by the user.

Embodiment 2

Double-sheet detection is to find out, through a measure, two identical materials that overlap. At present, two modes for achieving double-sheet detection through ultrasonic detection and by amplifying and driving a travel switch to act through a lever mechanism are widely used. The two modes can achieve double-sheet detection to a certain extent, but they have a significant limitation and a serious misjudgment. Based on this, the present disclosure conducts a further research.

In this embodiment, a double-sheet detection technology is achieved through an ultrasonic sensor or by driving a travel switch through a lever mechanism. These measures have significant drawbacks. The ultrasonic sensor makes a judgment by using a signal that ultrasonic waves pass through a material. If a single material is a complete single sheet, instead of being compounded, this mode has a relatively good effect. When two single sheets overlap, a signal reflected by the ultrasonic waves will be different, so that whether there are two sheets can be detected.

However, when a single material is compounded, such as corrugated paper (the single material is compounded by a plurality of layers of paper), although it is a single material, the ultrasonic sensor may basically determine the single material includes double sheets, this cannot achieve true double-sheet detection. The mode that the lever mechanism drives the travel switch is actually to use the principle of lever proportion to amplify a position change of a contact section and feed it back to a driving section through a lever. When the change at the driving section reaches a set double-sheet position, the travel switch may be triggered, providing a double-sheet signal. In this mode, it is very difficult for adjustment, and the action of the travel switch needs to have a certain change. If the thickness of the material at the contact section is small (less than 0.10 mm), it is difficult for the change at an output end to drive the travel switch to act (unless the lever at the output end is long). This can lead to a misjudgment and a thickness blind area. In response to the drawbacks of the above measures, the present disclosure combines the sensor and the lever mechanism organically, and a detected thickness change is calculated in real time through an algorithm to obtain an actual thickness of a current detected material; and when the detected thickness value exceeds a double-sheet material detection threshold, a double-sheet signal is sent immediately, thus achieving the purpose of double-sheet detection. This structure is ingenious and highly sensitive, and has no limitation on the texture and thickness of the detected material. This structure can be widely used in various scenarios that require double-sheet detection.

The double-sheet detection includes main assemblies 1 to 8 in the drawings, where 8 is a high-precision angle sensor for double-sheet detection, which is also a core assembly of the present disclosure. The high-precision angle sensor is axially connected to a transmission shaft 3 and is fixed on a side plate 2. A high-precision bearing is mounted at an output end of the transmission shaft 3 and is mounted on the side plate 2 through a bearing pedestal 7. A material pressing wheel 4 is mounted on the transmission shaft 3 by a connecting rod 5. When there is a material passing below the material pressing wheel 4, the material pressing wheel may be lifted up to drive the transmission shaft 3 to rotate. The transmission shaft 3 drives the high-precision angle sensor 8. A PLC (a single-chip microcomputer double-sheet detection controller) receives a signal change of the high-precision angle sensor 8. A real-time thickness value of the material below the material pressing wheel 4 is calculated through an algorithm to make a judgment. A free end of the transmission shaft 3 is fixed on the side plate 1 through a bearing pedestal 1 to ensure the accuracy of the action of the transmission shaft 3 driven by the material pressing wheel 4.

In a detection process, the algorithm is implemented in two modes; in early application, a PLC is used to communicate with the angle sensor 374 at a high speed to obtain data of the angle sensor 374, and the data is converted into an angle value. The calculated angle value is subtracted by an angle value at an initial position to obtain an angle value of actual swinging; and in a case that a size of the detection wheel 33 is known, an actual offset of a pressing wheel is obtained by a trigonometric function operation, thus obtaining an actual thickness of the material. Different PLCs have different instructions and logics, which, to some extents, increases the workload of programming. The algorithm contains many logics and calculations, which will also bring a load to the calculation of the PLC and prolong the cyclic scanning time of the PLC. When the PLC has a large number of programs, the operating efficiency may be slightly affected. Based on this situation, a mode is added, in which, a 32-bit high-speed single-chip microcomputer is used to transplant the communication and the algorithm to a specially developed single-chip microcomputer; and the single-chip microcomputer directly outputs a result. In this way, the calculation speed is higher, and the calculation workload of the PLC is greatly reduced. Different PLCs do not need to consider developing special algorithms, so that the application is more flexible and convenient, and the application scenario is more diversified.

This mode changes the unquantifiable situation caused by performing traditional ultrasonic detection and by amplifying and driving a travel switch to act through a lever mechanism. All pieces of data are presented in a dynamic form and can be stored, making it more convenient to call and analyze the data, which is more intuitive and convincing.

The above embodiments are only preferred embodiments of the present disclosure, and do not limit the protection scope of the present disclosure. Therefore, any equivalent changes made on the basis of the structure, shape, and principle of the present disclosure shall all fall within the protection scope of the present disclosure.

What is claimed is:

1. A double-sheet detection device, comprising a paper feeding machine body (1), wherein a main body plate (2) is arranged on an outer side of the paper feeding machine body (1); a detection mechanism (3) is arranged on an inner side of the main body plate (2); the paper feeding machine body (1) is provided with a storage assembly (4);

the detection mechanism (3) comprises a U-shaped plate (31); the U-shaped plate (31) is arranged on the inner side of the main body plate (2); an inner side top of the U-shaped plate (31) is fixedly connected with a first damper (32); a bottom of the first damper (32) is fixedly connected with a detection wheel (33); an angle sensor (374) is mounted on the detection wheel (33); a first spring (34) is fixedly connected to an exterior of the first damper (32); a top and bottom of the first spring (34) are fixedly connected with the inner side top of the U-shaped plate (31) and a top of the detection wheel (33), respectively; a rear side of the U-shaped plate (31) is fixedly connected with a transverse plate (35); a movement slot (36) is formed in the transverse plate (35); an interior of the movement slot (36) is connected with a movable block (37); the movable block (37) penetrates through the movement slot (36); a bottom of the movable block (37) is fixedly connected with a first electric telescopic rod (38); a bottom of the first electric telescopic rod (38) is fixedly connected with an auxiliary plate (39); a bottom of the auxiliary plate (39) is fixedly connected with a circular tube (391); and a bottom of the circular tube (391) is fixedly connected with a suction cup (392);

wherein the angle sensor (374) is coaxially connected to the detection wheel (33); when a material passes, the angle sensor (374) is driven by a rotating shaft; real-time data of the angle sensor (374) is obtained by high-speed communication with the angle sensor (374); and an actual thickness value of the material is calculated through an algorithm.

2. The double-sheet detection device according to claim 1, wherein a top of the transverse plate (35) is fixedly connected with a small air pump (393); an output end of the small air pump (393) is fixedly connected with an exhaust pipe (394); the exhaust pipe (394) penetrates through the auxiliary plate (39); and the exhaust pipe (394) extends into the circular tube (391) and is fixedly connected to the circular tube (391).

3. The double-sheet detection device according to claim 1, wherein a top of the transverse plate (35) is fixedly connected with a connecting plate; one side of the connecting plate is fixedly connected with a second electric telescopic rod (395); and one end of the second electric telescopic rod (395) is fixedly connected to one side of the movable block (37).

4. The double-sheet detection device according to claim 1, wherein a bottom of the U-shaped plate (31) is fixedly connected with a platform plate (396); a through slot is formed in the platform plate (396); and the first spring (34) and the first damper (32) both penetrate through the through slot.

5. The double-sheet detection device according to claim 1, wherein the calculated actual thickness value is compared with a double-sheet material detection threshold; if the actual thickness value exceeds the double-sheet material detection threshold, a double-sheet signal is immediately sent, which achieves a purpose of double-sheet detection, so that in addition to a mode of detection by manual visual inspection of scales, automatic detection is achieved synchronously; and the double-sheet detection via two modes greatly improves the flexibility and accuracy.

6. The double-sheet detection device according to claim 5, wherein in a detection process, the algorithm is implemented in two modes; in early application, a programmable logic controller (PLC) is used to communicate with the angle sensor (374) at a high speed to obtain data of the angle sensor (374), and the data is converted into an angle value;

The calculated angle value is subtracted by an angle value at an initial position to obtain an angle value of actual swinging; and in a case that a size of the detection wheel (33) is known, an actual offset of a pressing wheel is obtained by a trigonometric function operation, thus obtaining an actual thickness of the material.

7. The double-sheet detection device according to claim 6, wherein when the PLC has a large number of programs, the operating efficiency is slightly affected; a (33)-bit high-speed single-chip microcomputer is used to transplant the communication and the algorithm to a specially developed single-chip microcomputer;

and the single-chip microcomputer directly outputs a result.

8. The double-sheet detection device according to claim 1, wherein the detection mechanism (3) comprises a push-pull assembly; the push-pull assembly comprises two square plates (389); the two square plates (389) are fixedly connected to the inner side top of the main body plate (2); a rear side of one square plate (389) is fixedly connected with a motor (371); the motor (371) is fixedly connected to a switch (385); the motor (371) is fixedly connected with a threaded rotating rod (372) through an output shaft; the threaded rotating rod (372) penetrates through one of the square plates (389), and the threaded rotating rod (372) is rotatably connected to the two square plates (389) respectively; the top of the U-shaped plate (31) is fixedly connected with a linkage plate (373); the threaded rotating rod (372) penetrates through the linkage plate (373) and is in threaded connection with the linkage plate (373); the storage assembly (4) comprises a bearing plate (41); the bearing plate (41) is fixedly connected to the paper feeding machine body (1); a placement frame (42) is placed at a top of the bearing plate (41); the top of the bearing plate (41) is fixedly connected with two positioning plates (43); clamping slots are formed in the positioning plates (43); the placement frame (42) is fixedly connected with a rectangular plate (44); two grooves are formed in the rectangular plate (44); interiors of the grooves are slidably connected with clamping blocks (45); the clamping blocks (45) extend out of the rectangular plate (44); the two positioning plates (43) are respectively arranged on two sides of the rectangular plate (44); the positioning plates (43) are in contact with the rectangular plate (44); the clamping blocks (45) penetrate through the clamping slots and are matched with the clamping slots; one side of each clamping block (45) is fixedly connected with an auxiliary spring (46); and the auxiliary springs (46) are fixedly connected into the grooves.

* * * * *